United States Patent [19]

Corey

[11] 4,365,362

[45] Dec. 28, 1982

[54] DEVICE IMPROVING SOLUBILITY OF SOLID MATERIAL IN A CLOSED SYSTEM

[75] Inventor: Garland G. Corey, Milltown, N.J.

[73] Assignee: Sterling Drug Inc., New York, N.Y.

[21] Appl. No.: 255,659

[22] Filed: Apr. 20, 1981

[51] Int. Cl.[3] ..... E03D 9/02

[52] U.S. Cl. ..... 4/228; 4/227

[58] Field of Search ..... 4/228, 227, 225, 222, 4/223, 231; 222/190

[56] References Cited

U.S. PATENT DOCUMENTS

| | | | |
|---|---|---|---|
| 429,384 | 6/1890 | Mamaring | 4/228 |
| 495,563 | 4/1893 | Plumb | 4/228 |
| 685,020 | 10/1901 | Venners | 4/228 |
| 991,825 | 5/1911 | Bogie | 4/228 |
| 1,009,868 | 11/1911 | Tovey | 4/228 |
| 2,807,807 | 10/1957 | Harper | 4/228 |
| 3,521,306 | 7/1970 | Jacobs | 4/228 |
| 3,545,014 | 12/1970 | Davis | 4/228 |
| 3,591,873 | 7/1971 | Cheng | 4/225 |
| 3,604,020 | 9/1971 | Molsa | 4/228 |
| 3,715,765 | 2/1973 | Yadro | 4/228 |
| 3,831,205 | 8/1974 | Foley | 4/228 |
| 3,837,017 | 9/1974 | McDuffee | 4/228 |
| 3,943,582 | 3/1976 | Daeninckx et al. | 4/227 |
| 4,244,062 | 1/1981 | Corsette | 4/228 |
| 4,277,853 | 7/1981 | McDuffee | 4/228 |
| 4,318,891 | 3/1982 | Kim | 4/228 X |

FOREIGN PATENT DOCUMENTS 5493 of 1893 United Kingdom .

*Primary Examiner*—Henry K. Artis

*Attorney, Agent, or Firm*—Charles R. Fay

[57] ABSTRACT

A container having a disc, plate or the like located therein part way between the top and bottom of the container. In this disc there are provided a plurality of conical or similar structures, some extending above and some extending below the disc. These structures act as funnels. Structures extending generally below the device have their larger ends uppermost, and others of the structures that extend above the device have their smaller ends uppermost. Water or other fluid that is to act on the material in the container below the disc enters the wider ends of the dependent funnels or hollow structures to mix with the material under the disc, and the solution rises to exit through the inverted funnels or structures having their smaller ends uppermost.

12 Claims, 8 Drawing Figures

DEVICE IMPROVING SOLUBILITY OF SOLID MATERIAL IN A CLOSED SYSTEM

BACKGROUND OF THE INVENTION

Several commercial products are on the market comprising a container with soluble material therein in solid form wherein the material is dissolved and displaced into solution for active use thereof. One common area employing these devices is in the in-tank toilet bowl whereby the soluble product in a container is placed in the toilet tank water reservoir, below the upper level of the water therein, so that water enters the container through holes provided for the purpose, and material inside is gradually dissolved in a static state releasing solutions into the tank, and therefore, into the toilet itself. The material to be dissolved usually includes cleaning and deodorant ingredients. These products may be for example compositions containing solid nonionic surfactants or solids of halogen releasing agents such as chlorine agents.

British Pat. No. 5,493 illustrates a disinfecting apparatus for water closets having a conical member for the purpose of discharging a regulated quantity of water into a lower vessel where the cleaning or disinfectant substance is maintained, at each discharge of the flushing cistern.

U.S. Pat. No. 3,591,873 discloses a double-chamber toilet dispenser which is to be connected to a cistern flush pipe for dispensing disinfectant or cleaning material contained in a lower chamber upwardly through cylindrical passages to an upper chamber and thence out. Other patents which disclose double chamber devices for dispensing chemcials and solutions for the general purpose of cleaning and disinfecting toilets are as follows.

| U.S. Pat. No. | Date |
|---|---|
| 685,020 | October 22, 1901 |
| 2,807,807 | October 1, 1957 |
| 3,521,306 | July 21, 1970 |
| 3,545,014 | December 8, 1970 |
| 3,604,020 | September 14, 1971 |
| 3,715,765 | February 13, 1973 |
| 3,943,582 | March 16, 1976 |

The purpose of the present invention resides in the provision of a device to increase the uniformity and efficiency of release from the container of the cleaning or other material into the system.

SUMMARY OF THE INVENTION

The subject matter of the present invention comprises an effective container having top, bottom and side walls and there being means adjacent the upper end of the container, which may be opened by the user, to admit water or other fluid material to enter the container adjacent the top portion thereof. Part way down the sides of the container and attached thereto there is a partition in the form of a disc or plate, the position of which may depend upon the kind of material used and the speed with which it is wished to have the material dissolve. The disc divides the container into two separate portions. The disc mounts, or as a modification may embody, pass-through hollow structures or funnels certain of which have their larger ends uppermost and their smaller ends down extending toward the material to be dissolved; and others of such structures have their smaller ends pointing upwardly into the area of the dissolving fluid. Thus certain of the pass-through structures have downwardly converging walls and others have downwardly diverging walls, although these structures may be of shapes other than conical. These structures act as funnels. It has been found that the larger opening of each such structure should be at least 10% greater in diameter than the smaller opening thereof. The number of pass-through structures necessary to achieve the desired activity and their diameter openings are a function of the rate of dissolving of the solid material in the lower portion of the container and these parameters will vary under different situations.

The material to be dissolved receives the dissolving fluid from the upper portion of the container through the pass-through structures or funnels having their larger openings uppermost, once the container has been placed in the position where it can receive surrounding fluids. The fluid will tend to descend easily into the bottom portion of the container wherein is located the material to be dissolved, and the solution then tends to rise through the pass-through structures or funnels having their smaller ends uppermost. This is especially the case when some force is applied such as flushing a toilet, the device being located in the tank of the toilet. However, there are other areas where the device may be useful as for instance in vapor collecting, where the pass-through structures with their larger openings upwards allow an activator to flow onto a chemical that generates a gas, the gas then being collected by the inverted pass-through structures having their smaller ends uppermost.

Also a physical separation system could be provided that is due to specfic gravity differences with the heavier material in the bottom of the container below the disc, and the lighter specific gravity material would then rise and be taken off by some means made for this purpose.

PREFERRED EMBODIMENT OF THE INVENTION

Figure 1:
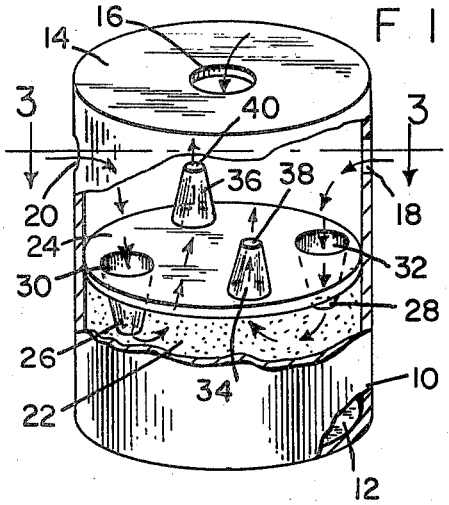
FIG. 1 is a sectional perspective view illustrating the construction of an example of the present invention.

FIG. 1 illustrates a container 10 having a bottom 12 and a top 14. This container may be made of any suitable material, glass, plastic, metal etc., and it is provided in its top with an opening 16 and also preferably in the side walls thereof there are openings 18 and 20. These openings will be temporarily closed in the trans-shipment and shelf life of the container, which has material 22 in the lower portion thereof which is to be dissolved and discharged in use.

Figure 2:
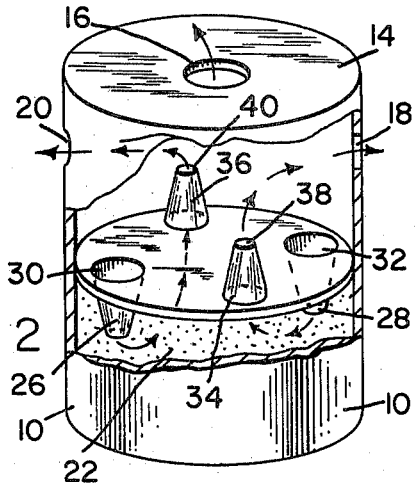
FIG. 2 is a similar view illustrating action taking place when the solution is discharged as indicated by the arrows therein.
Figure 3:
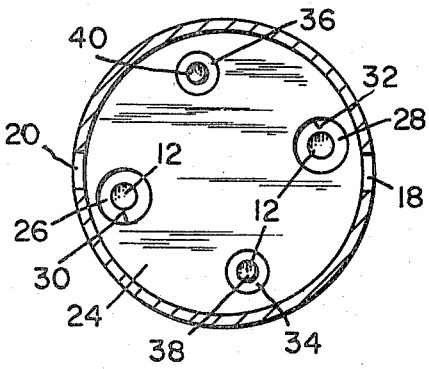
FIG. 3 is a section on line 3—3 of FIG. 1.

Intermediate the top and the bottom walls of the container there is a partition in the form of a disc or plate 24 preferably held in position; however, in some cases it may be loose. The disc is provided with a series of funnels or through hollow structures, referred to as "pass-through structures". In FIGS. 1 and 2 there are four of these structures, the reference numerals 26 and 28 showing structures pointing downwardly with their wider ends 30 and 32 opening upwardly in general co-planar relationship with respect to the top surface of disc or plate 24. There are two other similar hollow pass-through structures 34 and 36 which are similar to those at 26 and 28 but they are reversed extending upwardly from the disc or plate 24 and having their smaller open ends uppermost as at 38 and 40.

When solvent material, e.g. water, is introduced through any or all of the holes 16, 18 and 20, it tends to desend through the structures 26 and 28 into contact with the material 22 to be dissolved; and the dissolved material then tends to rise through the structures 36 and 38. By imposing some means for moving the solution out of the upper chamber the solution, of course, moves outwardly towards useful position. An example is the flush action of a toilet with the present device submerged in the tank, and the descending level of the water in the tank uncovers the holes referred to at 16, 18 and 20, thus allowing the cleaning solution or deodorant solution to discharge. This solution falls to the bottom of the toilet tank and flushes down into the toilet bowl. The upwardly directed pass-through structures 36 and 38 provide for greater efficiency and uniformity of the action of dissolving the material 22 in the bottom of the container and then discharging the same.

The pass-through structures may be produced in different parameters as to size, shape and other dimensions, and may either extend into the product below the disc or plate and above the product or combinations thereof. These parameters will be determined by the conditions at hand and the kind of product and solvent materials that are used.

Figure 4:
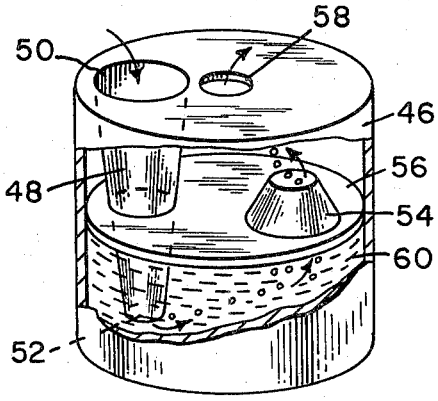
FIG. 4 is a sectional perspective view of a modification.

In FIG. 4 the invention is shown as providing a vapor collecting device where a container 46 is provided with a pass-through structure 48 located therein having its wider end 50 at its upper portion and its narrower end 52 at the bottom thereof. A differently shaped pass-through structure is inverted with respect to the structure 48 and this is shown at 54. Both of these pass-through structures are located on a disc 56 located in the median area of container 46 which has an opening at 58 for the exit of the vapor. An activator could be made to flow into a chemical as at 60 in the bottom of the container through the structure 48 and the gas would then be collected in the inverted funnel 54. Steam could be generated by pouring water onto hot rocks in the area at 60 or chemical gas generation of different kinds could also be achieved.

Figure 5:
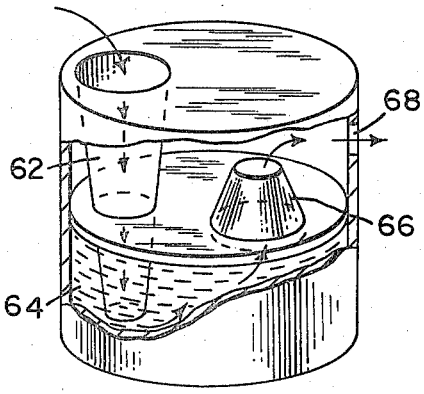
FIGS. 5 to 8 show other modifications.

FIG. 5 shows substantially the same thing where the pass-through structure 62 has applied thereto materials which will impinge upon material of heavy specific gravity in the bottom of the container at 64, lighter specific gravity material rising through pass-through structure 66 and being taken off, e.g. through an opening or port at 68.

Figure 6:
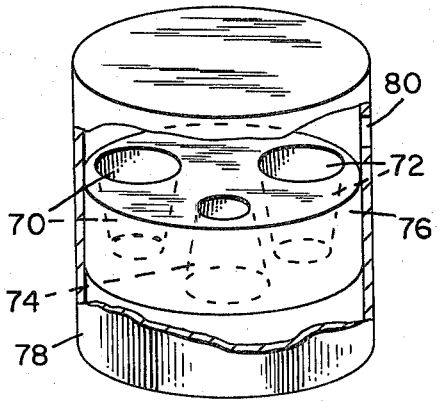

FIG. 6 shows a different construction wherein the pass-through structures 70, 72 and 74 may be completely enclosed within a fixed disc 76 and located again in the medial range of a container 78 with material to be dissolved in the bottom and with a vent or the like say for instance at 80 to discharge the solution.

Figure 7:
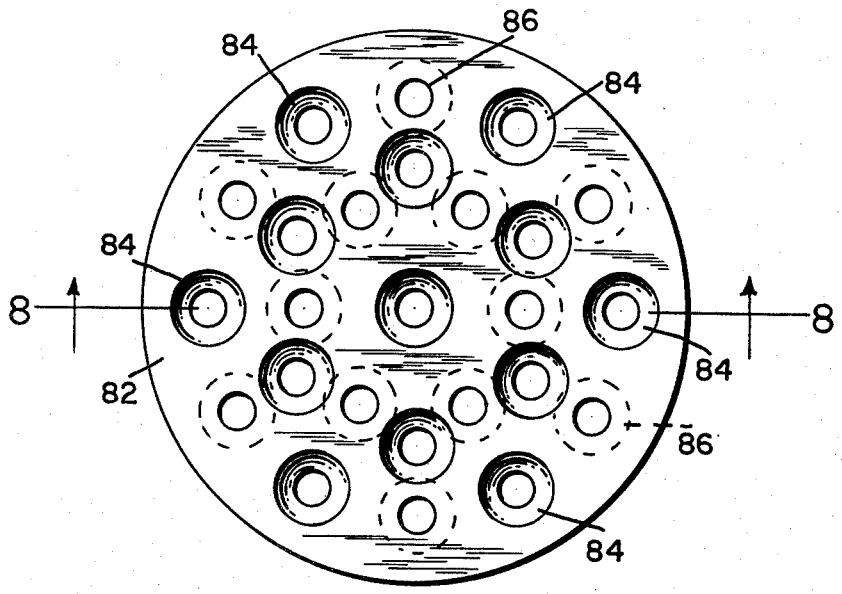
Figure 8:
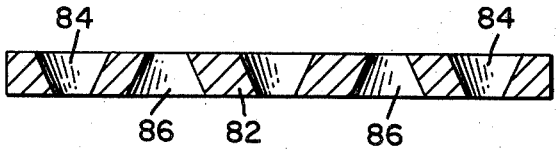

FIGS. 7 and 8 illustrate a variation on the structure of FIG. 6, although only the disc is shown. However, the general functions and the operation is as before. Disc 82 is relatively thinner than that of FIG. 6 and has a greater number of pass-through structures, there being twenty five as shown. Different sizes of such structures and different numbers thereof will be used for different containers of FIGS. 1 to 6 inclusive, as the structres may be of the same size and shape as shown as at 84 and 86. By using an odd number of pass-through structures, those wider at the top may predominate slightly, or if the disc be reversed the effect is, of course, the opposite. Also, there may be a predominance of more then one if desired, or they may be equal by using an even number of these structures evenly divided between those having wider openings and those having narrower openings at either side of the disc.

I claim:

1. A device of the class described comprising a container, said container having top, bottom, and side walls, a partition in the container located intermediate the top and bottom walls thereof, said partition dividing the container into top and bottom portions, the bottom portion being adapted to contain soluble material, at least two pass-through hollow structures located in the partition;

at least one pass-through structure having its larger end uppermost, and another pass-through structure having its smaller end uppermost, and a solvent admitting aperture in the upper portion of said container for the reception of the solvent therein above the partition, the solvent passing down through the pass-through structure with its larger end uppermost, and solution provided thereby tending to rise to and through the other pass-through structure which has its smaller end uppermost into the upper part of the container.

2. The device of claim 1 including a plurality of both pass-through structures associated with the partition.

3. The device of claim 1 wherein said device is adapted to be submerged in the solvent.

4. The device of claim 1 wherein the pass-through structure with the larger opening at the top depends wholly from the partition.

5. The device of claim 1 wherein the pass-through structure with the smaller end uppermost extends upwardly from the partition.

6. The device of claim 1 wherein said pass-through structures are located substantially wholly in the partition.

7. The device of claim 6 wherein the ends of the pass-through structures are substantially co-planar with the respective surfaces of the partition.

8. The device of claim 1 wherein the pass-through structures are frusto-conical.

9. A device of the class described comprising a container, the container including top, bottom, and side walls, a partition located intermediate the bottom and top wall, hollow pass-through structures in the partition, said structures having open ends of different sizes, at least one structure having its smaller end uppermost, and another hollow pass-through structure having its larger end uppermost, the partition providing a chamber at the upper portion of the container and a chamber in the lower portion of the container, the latter chamber containing material to be acted upon, wherein an activator therefor enters into the wider end of the hollow structure having its wider end uppermost to impinge upon the contents of the container chamber below the partition, the resultant material being collected in the hollow structure having its narrower end uppermost, passing therethrough into the chamber above the partition, and an opening in the upper chamber for the emission of the material generated by the activator in contact with the material in the lower part of the container.

10. The device of claim 9 wherein the hollow structures are located wholly in the partition.

11. The device of claim 9 wherein the larger ends of both hollow pass-through structures are located closely adjacent the partition.

12. The device of claim 9 wherein the hollow pass-through structures are frusto-conical in shape.

* * * * *